US006132481A

United States Patent [19]

Chandaria

[11] Patent Number: 6,132,481

[45] Date of Patent: Oct. 17, 2000

[54] FIRELOG WRAPPER

[75] Inventor: Kapoor Chandaria, Nairobi, Kenya

[73] Assignee: Conros Corporation, Scarborough, Canada

[21] Appl. No.: 09/290,788

[22] Filed: Apr. 12, 1999

[51] Int. Cl.[7] ..... C10L 5/00; C10L 11/06

[52] U.S. Cl. ..... 44/535; 44/541

[58] Field of Search ..... 44/535, 541

[56] References Cited

U.S. PATENT DOCUMENTS

| | | | |
|---|---|---|---|
| 4,040,796 | 8/1977 | Vincent et al. | 44/14 |
| 4,104,034 | 8/1978 | Wu et al. | 44/10 R |
| 4,179,269 | 12/1979 | Yates et al. | 44/10 B |
| 4,539,011 | 9/1985 | Kretzschmann | 44/14 |
| 4,775,391 | 10/1988 | Antosko | 44/520 |
| 4,878,922 | 11/1989 | Kaye | 44/502 |
| 4,883,498 | 11/1989 | MacIsaac | 44/532 |
| 5,112,365 | 5/1992 | MacIsaac et al. | 44/576 |

*Primary Examiner*—Ellen M. McAvoy
*Attorney, Agent, or Firm*—Sand & Sebolt

[57] ABSTRACT

A wrapper for an artificial firelog includes a sheet terminating at a longitudinal juncture and a pair of end junctures to form a cavity therein. The firelog is disposed inside the cavity. The longitudinal juncture is disposed along the top rear region of the firelog, thus increasing the likelihood that the front of the firelog will be properly and reliably ignited by the burning of the wrapper. Moreover, positioning the longitudinal juncture at the top rear region of the firelog causes only the front of the firelog to burn, thus resulting in a longer, more attractive fire at a relatively lower heat. Additionally, the positioning of the longitudinal juncture along substantially the top rear region of the firelog allows the manufacturer to imprint eye catching graphics on the wrapper along the front and top of the firelog without a seam, thus increasing the attractiveness and appeal of the firelog to potential purchasers.

9 Claims, 6 Drawing Sheets

FIRELOG WRAPPER

BACKGROUND OF THE INVENTION

1. Technical Field

The invention generally relates to artificial firelogs and, more particularly, to an artificial firelog having a wrapper that is used to ignite the firelog. Specifically, the invention relates to the combination of a wrapper and an artificial firelog where the wrapper has a longitudinal juncture at the top rear portion of the firelog such that a larger portion of the wrapper rolls in front of the firelog when the wrapper is burned than in back of the log.

2. Background Information

Various types of fuel bodies have been developed, most of which are formed of particulate flammable materials which are compressed into a predetermined shape. The particulate materials are combined with various wax binders and other binders for maintaining the desired shape of the final fuel body. These bodies also may contain various types of additives therein to enhance burning or to produce a colored flame.

Certain of these fuel bodies are of an elongated shape and are formed of compressed sawdust, coal particles, or other inflammable materials. These fuel bodies are typically referred to as firelogs and may be formed by a continuous extrusion process wherein the particulate inflammable materials and the appropriate binders and other materials are compressed within an extrusion bore, are cut to predetermined lengths, and are subsequently placed into a protective outer wrapper. The artificial firelog is then used by the consumer by placing it onto a fireplace grate and igniting the protective outer wrapper with a match or other flame source. The combustion of the protective outer wrapper burns in close proximity with the artificial firelog ignites the firelog.

The protective outer wrapper for the firelog serves a number of purposes. The protective outer wrapper retains the firelog and its components within a sealed cavity, thus preventing the combustible particles and the binder materials from contaminating the user's hands, clothing, etc. The wrapper also helps to retain any objectionable odors that otherwise might be produced by the artificial firelog. The outer wrapper additionally serves as a vehicle for receiving graphical imprintation by the manufacturer that catches the eye of potential purchasers and that provides information regarding the proper use of the firelog. Moreover, the wrapper is relatively easy to light and provides sufficient sustained combustion to ignite the artificial firelog. Such outer wrappers have not, however, been without limitation.

As is known and understood in the relevant art, the outer wrapper consists of a sheet of paper or other such material that is wrapped about the firelog and is sealed to form a longitudinal juncture extending the length of the log at substantially the middle of the top surface thereof. The longitudinal juncture is positioned at substantially the center of the top surface of the firelog and protrudes outwardly therefrom to provide a convenient wick that the user can light with a flame source such as a match or a lighter. Once lit, the wrapper then burns from the longitudinal juncture in both forward and rearward directions, thus igniting the firelog along both the front and rear surfaces. The simultaneous combustion of both front and rear surfaces of the firelog results in the firelog producing a large flame and being consumed relatively quickly. Inasmuch as the rear surface of the firelog typically faces away from the observer, combustion of the rear of the firelog simultaneously with the front is wasteful. It is thus desired in the art to provide a firelog and firelog wrapper that primarily ignites the front of the firelog when the wrapper is lit.

Another disadvantage with the prior art wrapper is that the longitudinal seam disposed at substantially the center of the top surface provides a poor vehicle for accepting the printed graphics that are intended to catch the eye of the purchaser. The wrappers are typically imprinted prior to it being wrapped around the firelog. The process of forming the longitudinal juncture often obscures the graphics or otherwise interferes with the desired graphical result, thus limiting the consumer appeal of the firelog. It is thus desired in the art to provide a firelog wrapper that locates the seam in a less prominent location.

Additionally, inasmuch as the burning of the wrapper must provide heat for a sufficient duration to ignite the firelog, the wrapper is sometimes too small to fully ignite the firelog, thus resulting either in an improperly lighted firelog or a firelog that has not been lit at all. While attempts have been made to coat the paper used in making the wrapper with combustion-enhancing materials such as wax, such efforts have remained less than fully reliable in properly lighting an artificial firelog on a consistent basis.

Thus, the need exists for an artificial firelog wrapper that properly and consistently ignites a firelog without the rear of the firelog being unnecessarily consumed and that provides an improved vehicle for accepting the graphical imprintation provided by the manufacturer for catching the attention of the purchaser.

SUMMARY OF THE INVENTION

In view of the foregoing, an objective of the present invention is to provide a wrapper for an artificial firelog that serves as an improved vehicle for accepting the graphical imprintation by the manufacturer to present an improved appearance to the purchaser.

Another objective of the present invention is to provide a wrapper for an artificial firelog that provides improved reliability in lighting the front surface of the firelog.

Another objective of the present invention is to provide a wrapper for an artificial firelog that minimizes the extent to which the rear surface of the firelog ignites during the initial combustion of the firelog.

Another objective of the present invention is to provide a wrapper for an artificial firelog that has a longitudinal juncture disposed at substantially the top rear region of the firelog.

Another objective of the present invention is to provide a wrapper for an artificial firelog wherein a larger portion of the wrapper is positioned to ignite the front of the firelog than the rear of the firelog.

These and other objectives and advantages are obtained by the improved firelog wrapper of the present invention, the general nature of which may be stated as including a sheet of wrapping material adapted to surround the firelog, the sheet terminating at a longitudinal juncture, the longitudinal juncture adapted to be disposed substantially along the top rear region of the firelog.

Other objectives and advantages are obtained by the improved firelog and wrapper combination of the present invention, the general nature of which may be stated as including a wrapper comprising a sheet of wrapping material terminating at a longitudinal juncture and an artificial firelog having a top and a rear surface, the top and the rear surfaces intersecting at a top rear region, the firelog disposed in the wrapper, and the longitudinal juncture disposed substantially adjacent the top rear region of the firelog.

Still other objectives and advantages are obtained by the method of enclosing an artificial firelog in a wrapper, the general nature of which may be stated as including the steps of enclosing the firelog within a sheet of wrapper material, attaching the front and rear flaps of the sheet to one another to form a longitudinal juncture, and positioning the longitudinal juncture substantially along the top rear region of the firelog.

Still other objectives and advantages are obtained by the method of lighting a firelog, the general nature of which may be stated as including the steps of igniting the longitudinal juncture with the flame source, burning a larger portion of the wrapper adjacent the front of the firelog, and burning a smaller portion of the wrapper adjacent the rear of the firelog.

BRIEF DESCRIPTION OF THE DRAWINGS

The preferred embodiments of the invention, illustrative of the best modes in which applicant has contemplated applying the principles of the invention, are set forth in the following description and are shown in the drawings and are particularly and distinctly pointed out and set forth in the appended claims.

Similar numerals refer to similar parts throughout the specification.

DESCRIPTION OF THE PREFERRED EMBODIMENTS

Figure 1:
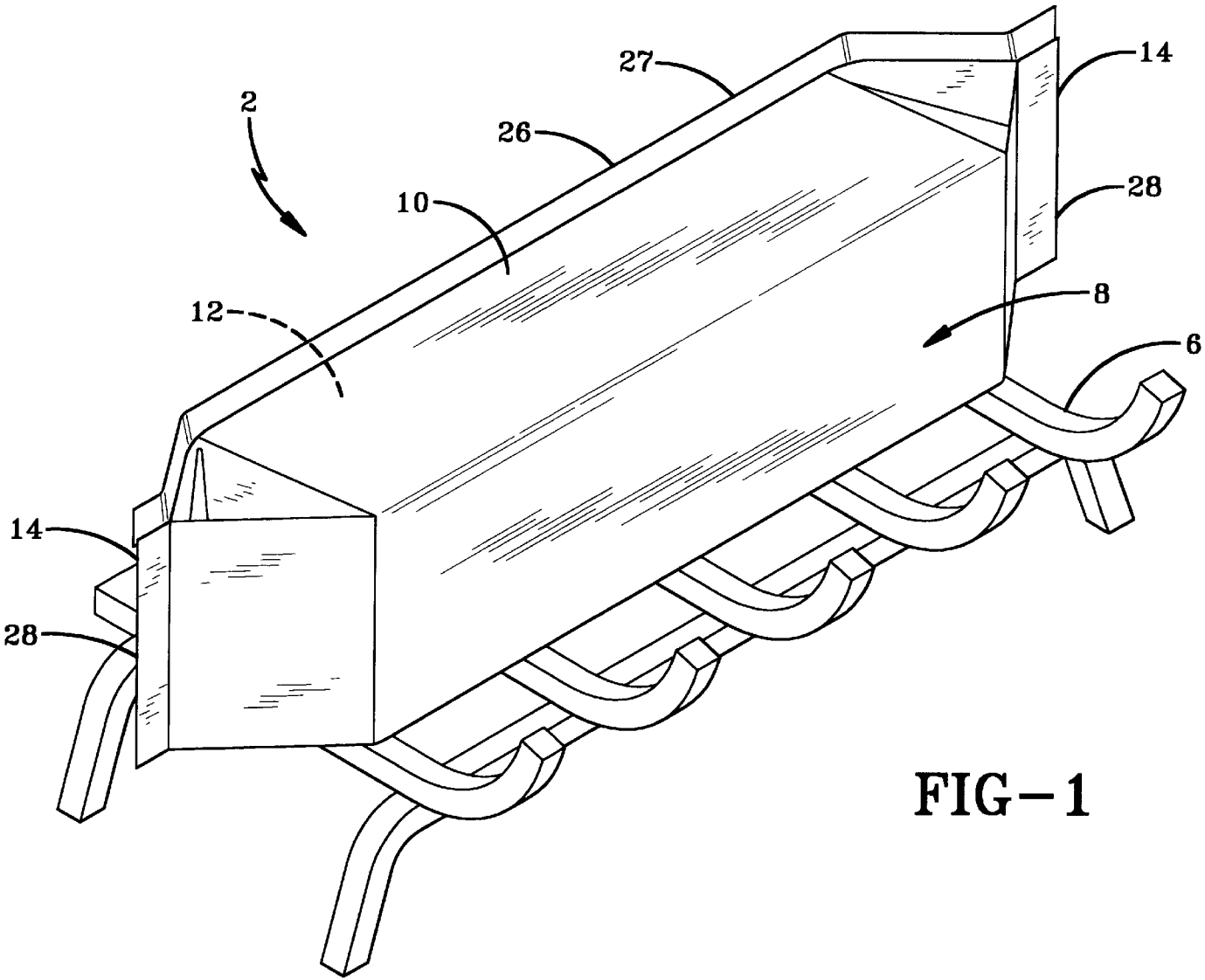
FIG. 1 is a perspective view of the firelog and wrapper combination of the present invention disposed on a fireplace grate.

The outer wrapper of the present invention is indicated generally at the numeral 2 in the accompanying drawings. Wrapper 2 encloses an artificial firelog 4 of the type known and understood in the relevant art. In use, the combination of wrapper 2 and firelog 4 is placed on a fireplace grate 6. Wrapper 2 is then ignited with matches or other flame source, with the combustion of wrapper 2 resulting in the ignition of firelog 4.

Wrapper 2 is formed of a sheet 8 of combustible material such as paper or other appropriate material. As is understood in the relevant art, sheet 8 may be coated with a combustion-enhancing material such as wax or other appropriate material, although the need for coating and the particular material to be used for the coating vary with the specific application.

Sheet 8 is a substantially rectangular piece of material that is wrapped around firelog 4 and is sealed to form a substantially airtight cavity 9 within which firelog 4 is disposed. Sheet 8 includes a front flap 10 and a rear flap 12, with front and rear flaps 10 and 12 each terminating at a pair of common opposed ends 14.

Firelog 4 is a firelog of the type known and understood in the relevant art formed of a particulate combustible material held together with a binder and formed into a desired shape. A first configuration of firelog 4 is depicted in FIGS. 1–4. A second configuration of firelog 4 is depicted in FIGS. 5–8. The first and second configurations have different cross sections. It is understood, however, that firelog 4 may be of essentially any shape desired for a particular application without departing from the spirit of the present invention.

Firelog 4 has a top surface 16, a bottom surface 18, a front surface 20, and a rear surface 22. When properly positioned, top surface 16 and front surface 20 face the observer. Rear surface 22 faces away from the user and into the fireplace. Top surface 16 points upwardly toward the chimney (not shown) and bottom surface 18 rests against grate 6. Top surface 16 and rear surface 22 intersect or otherwise meet at a top rear region 24. Firelog 4 is also formed with a longitudinal notch 25 substantially at the intersection of bottom surface 18 and front surface 20.

As indicated hereinbefore, sheet 10 surrounds firelog 4 to form wrapper 2. In forming wrapper 2, the edges of front flap 10 and rear flap 12 are connected to one another to form a longitudinal juncture 26 that extends between ends 14 of sheet 8 and is disposed substantially along top rear region 24 of firelog 4. Front and rear flaps 10 and 12 are attached to one another with an appropriate adhesive of the type known and understood in the art, although front and rear flaps 10 and 12 may be attached to one another in various fashions such as with the use of adhesive tape or staples without departing from the spirit of the present invention.

Longitudinal juncture 26 preferably protrudes outwardly from sheet 8 to form a wick 27 that can easily be lit with a match or other flame source. It is further preferred that wick 27 extends in a generally upwardly direction from sheet 8 to facilitate lighting, although in other configurations (not shown) wick 27 may be desired to extend rearwardly or in other directions from sheet 8 depending upon the particular application without departing from the spirit of the present invention.

Ends 14 are then sealed to form a pair of end junctures 28. Specifically, the portions of each end 14 that are opposite each other are joined together as is indicated generally in FIG. 1. The aforementioned portions of each end 14 are connected to one another with the same adhesive or other attachment system used to form longitudinal juncture 26, although other attachment methods may be employed without departing from the spirit of the present invention.

It is preferred that longitudinal juncture 26 and end junctures 28 are connected whereby a flame applied to longitudinal juncture 26 will travel along longitudinal juncture 26, igniting longitudinal juncture 26, and ultimately traveling to and igniting end junctures 28.

In use, wrapper 2 and firelog 4 are placed on grate 6 within a fireplace. A flame supplied by a match or other flame source is applied to one or more points along longitudinal juncture 26. It is preferred that the flame be applied to the ends and approximately the midpoint of longitudinal juncture 26, although other lighting methods can be used without departing from the spirit of the present invention. As wick 27 and end junctures 28 burn, the flame heats the surface of firelog 4 in the regions adjacent the combustion of wrapper 2.

Once the flame has burned through wick 27 and end junctures 28, front and rear flaps 10 and 12 are no longer attached to one another and fall adjacent front surface 20 and rear surface 22. With front and rear flaps 10 and 12 fallen away from one another (FIG. 3), the combustion of front and rear flaps 10 and 12 continues to raise the surface temperature of front surface 20 and rear surface 22, respectively, of firelog 4. Inasmuch as longitudinal juncture 26 is disposed at substantially top rear region 24 of firelog 4, it is understood that front flap 10 encompasses a larger area of sheet 8 than rear flap 12. In accordance with the features of the present invention, therefore, when front and rear flaps 10 and 12 have fallen away from one another (FIG. 3) a substantially greater portion of sheet 8 burns against front surface 20 than burns against rear surface 22. Front surface 20 is thus heated more than rear surface 22 and ignites faster and over a larger area than rear surface 22. In the preferred embodiment of the invention, about twice as much of sheet 8 burns in front of log 4 than in back of log 4.

Figure 4:
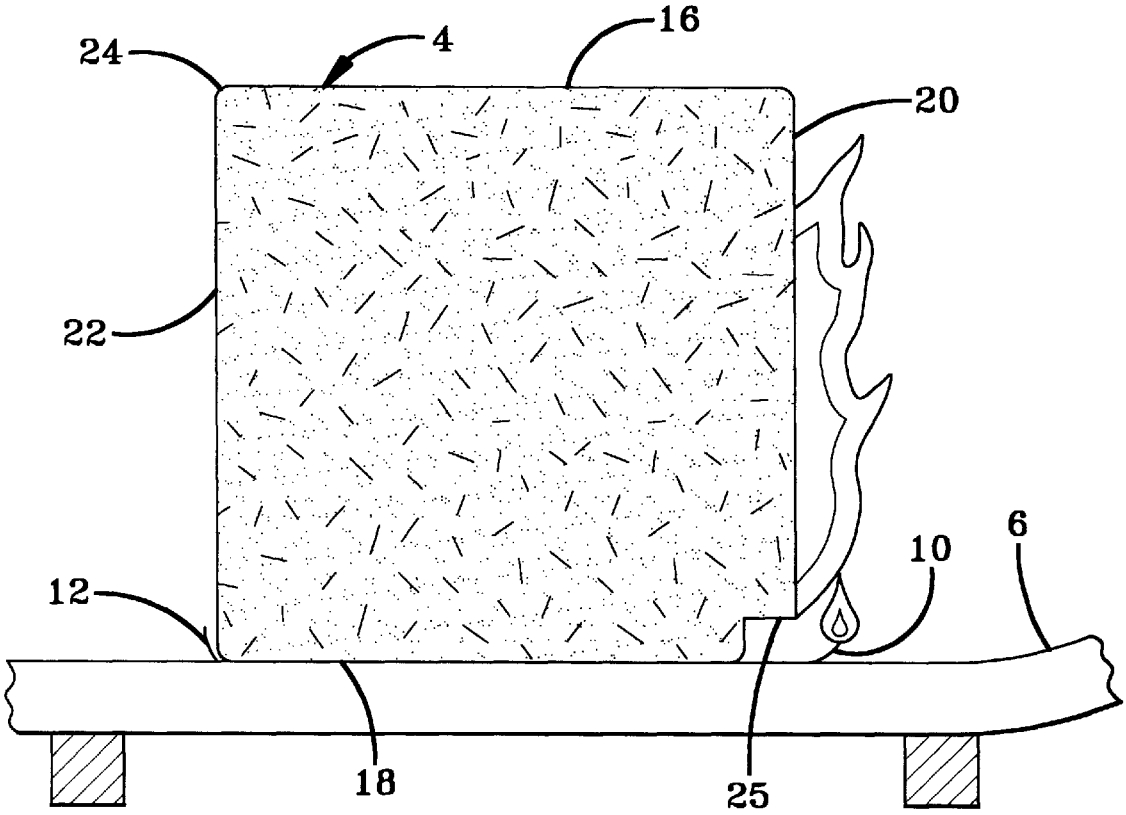
FIG. 4 is a view similar to FIGS. 2 and 3 showing the ignition of the front of the firelog.
Figure 5:
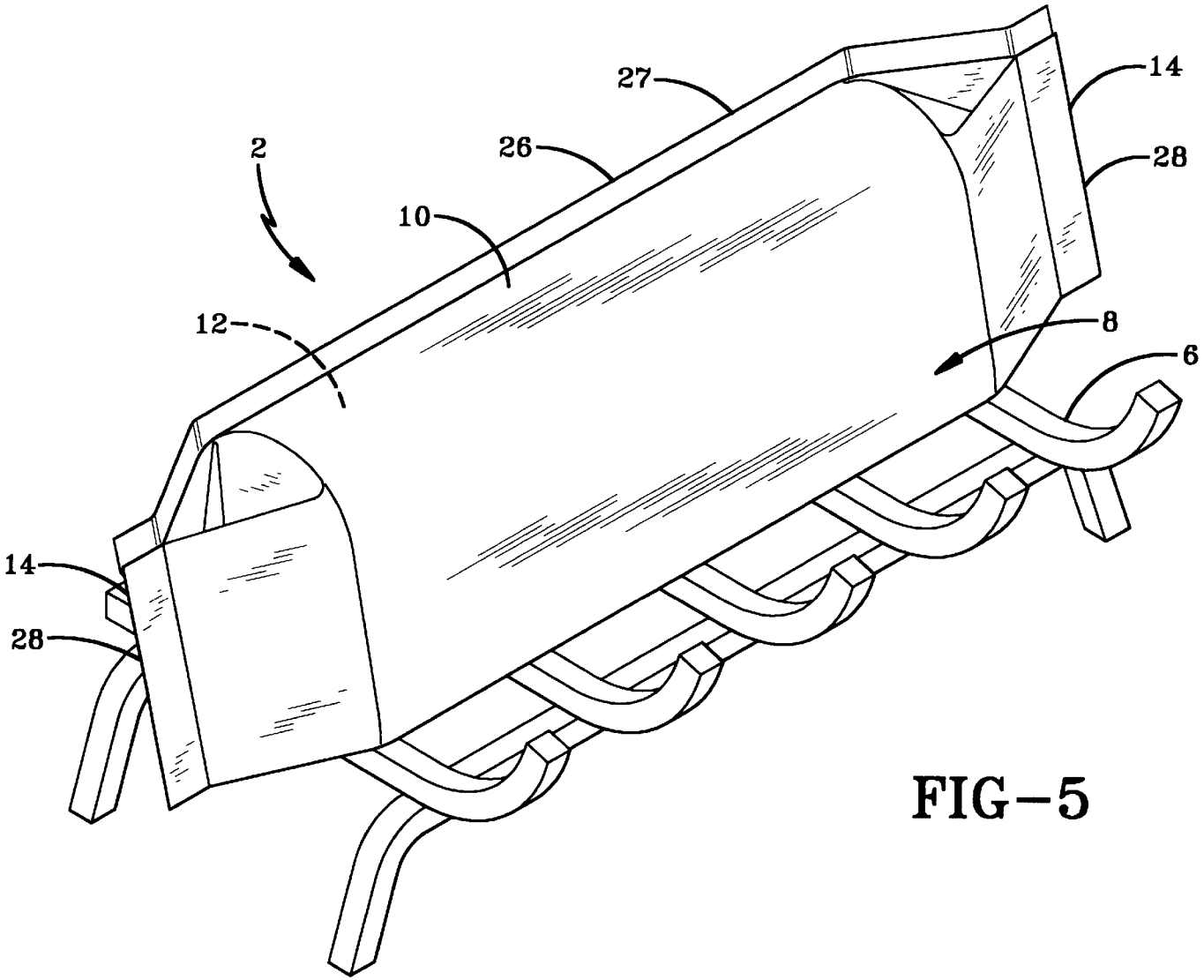
FIG. 5 is a perspective view of an alternative embodiment of the firelog wrapper combination of the present invention disposed on a fireplace grate.

Once the surface temperature of front surface 20 has been raised sufficiently by the combustion of front flap 10, front surface 20 of firelog 4 begins to burn (FIG. 4). As is generally understood in the relevant art, such combustion typically will be initiated at the horizontal edge of notch 25, with the flames extending upwardly therefrom. Further in accordance with the objectives of the present invention, a relatively smaller proportion of sheet 8 is available to raise the temperature of rear surface 22 of firelog 4, and rear surface 22 moreover is free of notches formed therein. As such, rear flap 12 falls adjacent rear surface 22 of firelog 4 and burns without igniting rear surface 22 or at least only minimally igniting it.

In accordance with the objectives of the present invention, therefore, the positioning of longitudinal juncture 26 substantially along top rear region 24 of firelog 4 increases the combustion reliability of firelog 4 by ensuring that it is ignited fully and properly. Moreover, the positioning of longitudinal juncture 26 as disclosed herein minimizes the possibility that rear surface 22 will ignite by the combustion of wrapper 2. The combustion of only front surface 20 of firelog 4 thus avoids the needless and wasteful simultaneous combustion of rear surface 22, eliminates the production of unnecessarily high levels of heat, and allows firelog 4 to burn relatively longer than if both front surface 20 and rear surface 22 were ignited simultaneously by the burning of wrapper 2.

In other embodiments of the invention, longitudinal juncture 26 is positioned between top rear region 24 and the lowermost end of rear surface 22. This configuration allows wrapper 2 to start burning before rolling over top surface 16 and into position adjacent front surface 20.

Figure 6:
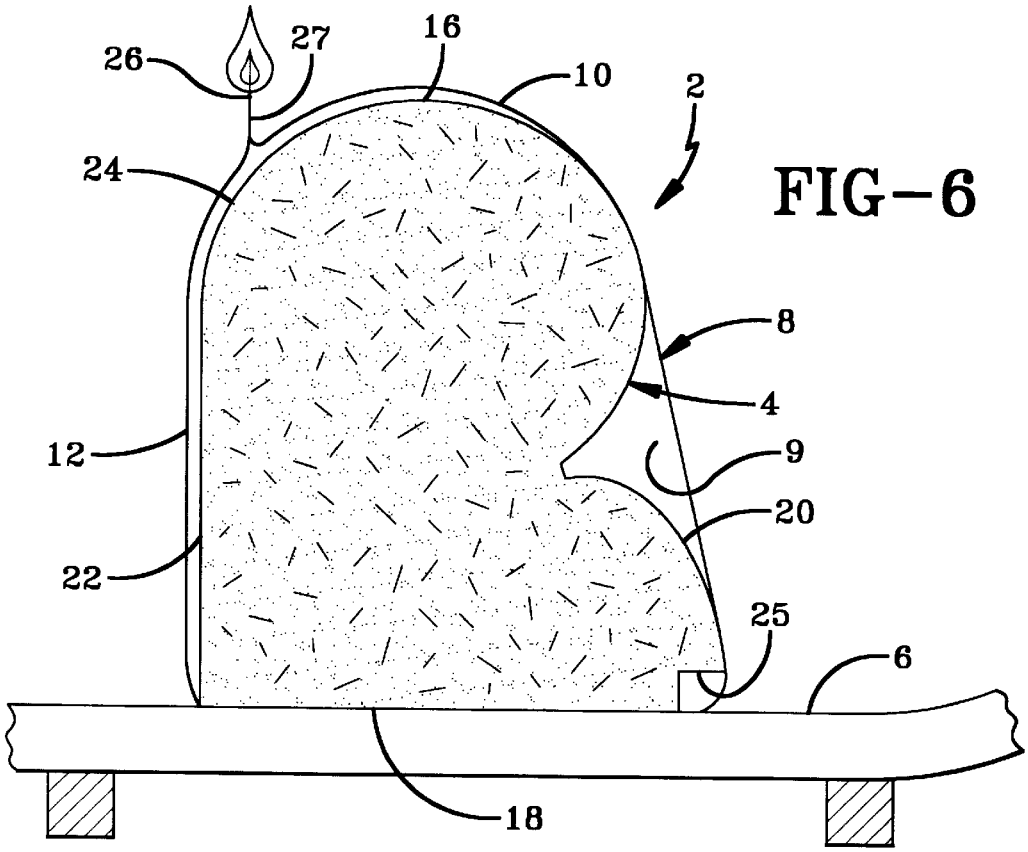
FIG. 6 is a sectional side view of the firelog and wrapper of FIG. 5 showing the longitudinal juncture being ignited.
Figure 7:
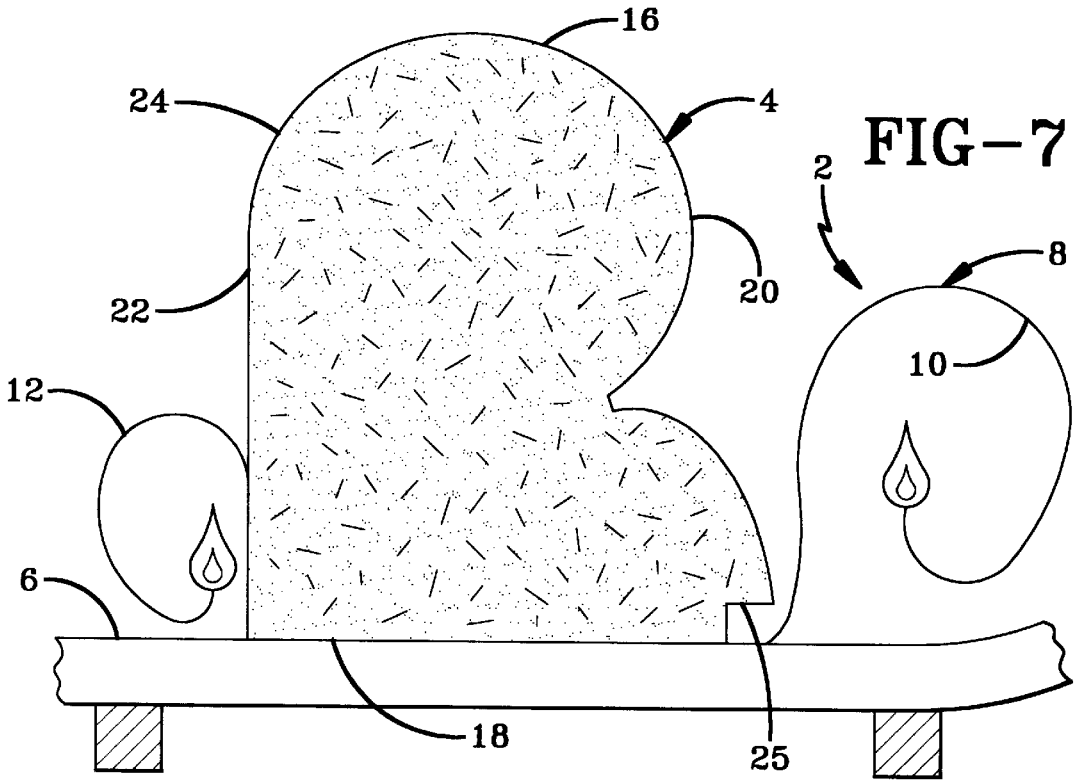
FIG. 7 is a view similar to FIG. 6 showing the front and rear flaps of the wrapper burning.
Figure 8:
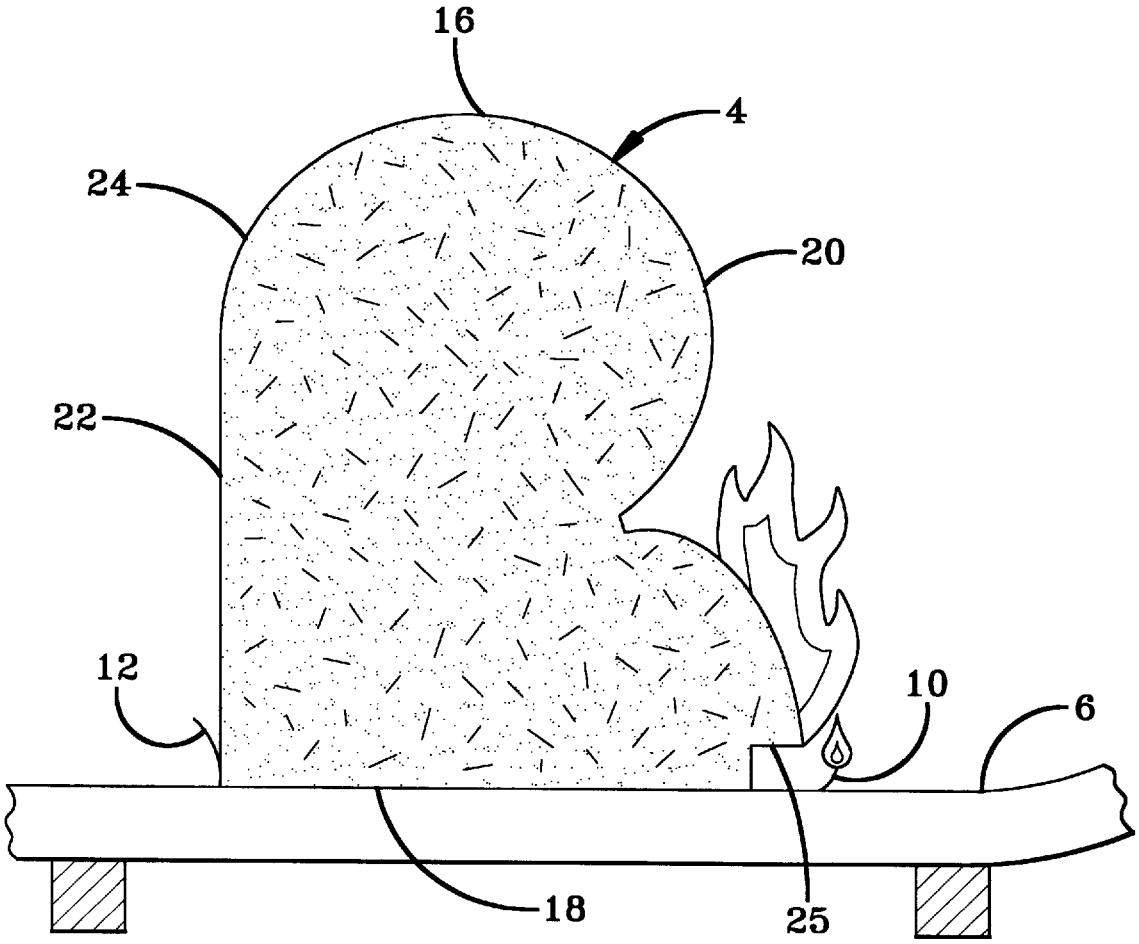
FIG. 8 is a view similar to FIGS. 6 and 7 showing the ignition of the front of the firelog.

Firelog 4 may be of substantially any cross section needed without departing from the spirit of the present invention. In this regard, FIGS. 5–8 depict an alternative embodiment of firelog 4 and the resultant wrapper 2 that encloses firelog 4 for selective ignition by the consumer. As can be seen in FIGS. 6 and 7, wick 27 is disposed substantially at top rear region 24 of firelog 4, but inasmuch as top surface 16 has a smooth transition with rear surface 22, it can be seen that the second configuration of firelog 4 is ignited reliably and effectively by positioning longitudinal juncture 26 substantially adjacent the intersection between top surface 16 and rear surface 22.

Figure 2:
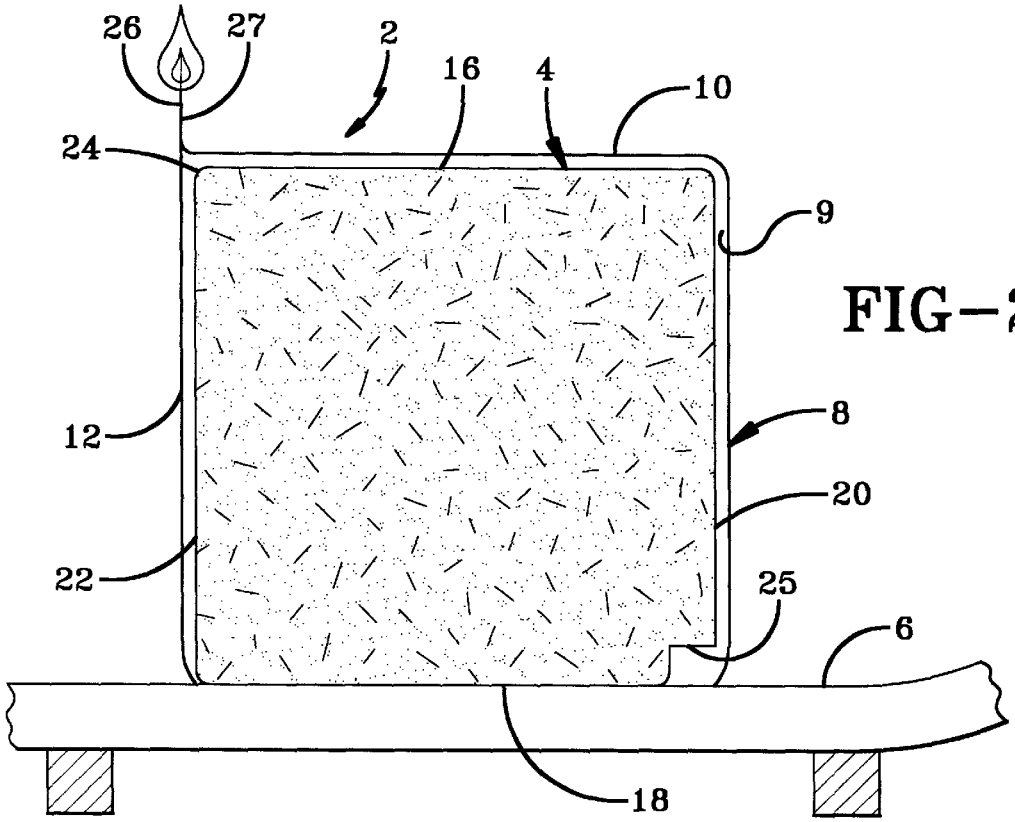
FIG. 2 is a sectional view of the present invention showing the longitudinal juncture of the wrapper being ignited.
Figure 3:
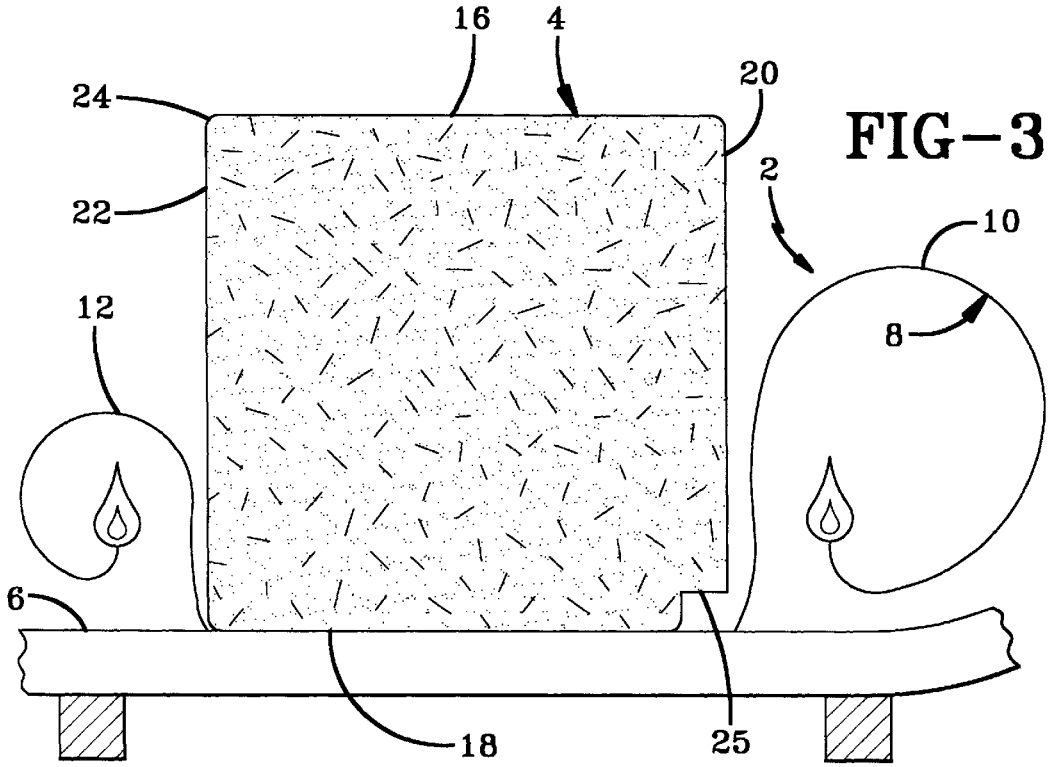
FIG. 3 is a view similar to FIG. 2 showing the front and rear flaps of the wrapper burning.

In accordance with another objective of the present invention, and as is best shown in FIGS. 2 and 6, front flap 10 extends across front surface 20 and top surface 16 of firelog 4 without a seam or other obstruction thereon. The entire surface of front flap 10 can thus be imprinted without interruption. This allows the manufacturer to produce eye catching graphics along an uninterrupted area of front surface 20 and top surface 16 of firelog 4 that are uninterrupted by a seam or juncture, further providing appeal to potential purchasers. By providing a more attractive packaging system than that previously known in the relevant art, wrapper 2 is more aesthetically pleasing to potential purchasers and is more likely to be purchased and used than others having a seam across the middle of top surface 16.

Accordingly, the improved firelog wrapper is simplified, provides an effective, safe, inexpensive, and efficient device which achieves all the enumerated objectives, provides for eliminating difficulties encountered with prior devices, and solves problems and obtains new results in the art.

In the foregoing description, certain terms have been used for brevity, clearness, and understanding; but no unnecessary limitations are to be implied therefrom beyond the requirement of the prior art, because such terms are used for descriptive purposes and are intended to be broadly construed.

Moreover, the description and illustration of the invention is by way of example, and the scope of the invention is not limited to the exact details shown or described.

Having now described the features, discoveries, and principles of the invention, the manner in which the firelog wrapper is constructed and used, the characteristics of the construction, and the advantageous new and useful results obtained; the new and useful structures, devices, elements, arrangements, parts, and combinations are set forth in the appended claims.

I claim:

1. In combination, a wrapper including a sheet of wrapping material having first and second longitudinal edges, the first and second longitudinal edges being joined together to form a wick extending outwardly from the sheet; and an artificial firelog having a top and a rear surface, said top and said rear surface intersecting at a top rear longitudinal corner;

said firelog disposed in said wrapper; and said wick disposed substantially adjacent said top rear longitudinal corner of said firelog.

2. The combination as set forth in claim 1, wherein said wick protrudes outwardly from said sheet and is adapted to be ignited with a flame source.

3. The combination as set forth in claim 2, wherein said sheet additionally terminates at a pair of end junctures that protrude outwardly from said sheet.

4. The combination as set forth in claim 3, wherein said wick terminates at said end junctures.

5. The combination as set forth in claim 1, wherein said wrapper has an uninterrupted area disposed adjacent the top and rear surfaces of the firelog.

6. A method for enclosing an artificial firelog in a wrapper, the firelog having a top surface and a rear surface intersecting at a top rear longitudinal corner, the wrapper including a sheet having a front flap, a rear flap, and a pair of ends, the front and rear flaps terminating at the ends, the method comprising the steps of:

enclosing the firelog within the sheet;

attaching the front and rear flaps of the sheet to one another to form a longitudinal wick; and positioning the longitudinal wick adjacent the top rear longitudinal corner of the firelog.

7. The method as set forth in claim 6, further comprising the step of sealing the ends of the sheet to form end junctures.

8. A method for igniting an artificial firelog in a wrapper with a flame source, the firelog having a front surface, a rear surface, and a top surface, the top and rear surfaces intersecting at a top rear longitudinal corner, the wrapper the wrapper having first and second longitudinal edges, the first and second longitudinal edges being joined together to form a longitudinal wick extending outwardly from the sheet; the firelog disposed inside the wrapper, the longitudinal wick being disposed substantially adjacent the top rear longitudinal corner of the firelog, the method comprising the steps of:

igniting the wick with the flame source;

burning a larger portion of the wrapper adjacent the front of the firelog; and burning a smaller portion of the wrapper adjacent the rear of the firelog.

9. The method of claim 8, further comprising the step of causing a larger portion of the wrapper to unwrap and curl in front of the firelog.

* * * * *